US010036982B2

(12) United States Patent
Sawamoto et al.

(10) Patent No.: US 10,036,982 B2
(45) Date of Patent: Jul. 31, 2018

(54) CARRIER AND ELECTROPHOTOGRAPHIC DEVELOPER USING THE CARRIER

(71) Applicant: POWDERTECH CO., LTD., Chiba (JP)

(72) Inventors: Hiroki Sawamoto, Chiba (JP); Tetsuya Uemura, Chiba (JP)

(73) Assignee: POWDERTECH CO., LTD., Chiba (JP)

( * ) Notice: Subject to any disclaimer, the term of this patent is extended or adjusted under 35 U.S.C. 154(b) by 0 days.

(21) Appl. No.: 15/007,415

(22) Filed: Jan. 27, 2016

(65) Prior Publication Data

US 2016/0216643 A1 Jul. 28, 2016

(30) Foreign Application Priority Data

Jan. 27, 2015 (JP) ..... 2015-013780

(51) Int. Cl.

| | |
|---|---|
| ***G03G 9/10*** | (2006.01) |
| ***G03G 9/107*** | (2006.01) |
| ***G03G 9/113*** | (2006.01) |
| ***G03G 15/09*** | (2006.01) |

(52) U.S. Cl.

CPC ..... *G03G 15/0928* (2013.01); *G03G 9/10* (2013.01); *G03G 9/1075* (2013.01); *G03G 9/1131* (2013.01); *G03G 9/1132* (2013.01); *G03G 9/1138* (2013.01)

(58) Field of Classification Search

CPC .... G03G 15/0928; G03G 9/10; G03G 9/1138; G03G 9/1131; G03G 9/1132; G03G 9/1075

See application file for complete search history.

(56) References Cited

U.S. PATENT DOCUMENTS

| | | | | |
|---|---|---|---|---|
| 2010/0248125 | A1 | 9/2010 | Hikichi et al. | |
| 2011/0013948 | A1 | 1/2011 | Koji et al. | |
| 2012/0251191 | A1 | 10/2012 | Sugiura et al. | |
| 2013/0244159 | A1* | 9/2013 | Ishigami ..... | G03G 9/1075 430/106.2 |
| 2014/0287355 | A1 | 9/2014 | Sawamoto et al. | |
| 2015/0192874 | A1 | 7/2015 | Kinoshita et al. | |

FOREIGN PATENT DOCUMENTS

| | | | |
|---|---|---|---|
| EP | 2615499 | A1 | 7/2013 |
| EP | 2696244 | A1 | 2/2014 |
| EP | 2927750 | A1 | 10/2015 |
| JP | 2007-034249 | A | 2/2007 |
| JP | 2009-244572 | A | 10/2009 |
| JP | 2012-215858 | A | 11/2012 |
| JP | 2013-250455 | A | 12/2013 |
| JP | 2014-197040 | A | 10/2014 |

OTHER PUBLICATIONS

European Search Report issued with respect to application No. 16152861.7, dated May 31, 2016.

* cited by examiner

*Primary Examiner* — Thorl Chea

(74) *Attorney, Agent, or Firm* — Greenblum & Bernstein P.L.C.

(57) ABSTRACT

An object of the present invention is to provide a carrier in which decrease in specific gravity is achieved and a volatile organic compound (VOC) is reduced and to provide an electrophotographic developer using the carrier. There is provided a carrier including a core material coated with a resin, the core material including a magnetic component and a nonmagnetic component, wherein the sum total of volatile organic compounds is 1 ppb or more and 1.5 ppm or less. There is also provided an electrophotographic developer using the carrier.

7 Claims, No Drawings

CARRIER AND ELECTROPHOTOGRAPHIC DEVELOPER USING THE CARRIER

BACKGROUND OF THE INVENTION

Field of the Invention

The present invention relates to a carrier having low specific gravity in which the content of volatile organic compounds (VOC) is suppressed to a fixed range, and specifically relates to a carrier used in a two-component electrophotographic developer used for copying machines, printers, and the like, and an electrophotographic developer using the carrier.

Description of the Related Art

An electrophotographic developing method is a method of developing by adhering toner particles in a developer to an electrostatic latent image formed on a photo conductor, and the developer used in this method is divided into a two-component developer including toner particles and carrier particles and a one-component developer using only toner particles.

Among such developers, a cascade process and the like used to be employed as a developing method using the two-component developer including toner particles and carrier particles, but a magnetic brush method for using a magnet roll is mainly used at present.

In the two-component developer, the carrier particles are a carrier material for imparting desired charge to the toner particles by being stirred with the toner particles in a developing box filled with the developer and conveying the toner particles carrying charge in this way to the surface of the photo conductor to form a toner image on the photo conductor. The carrier particles remaining on a developing roll holding a magnet return from the developing roll to the developing box again, are mixed and stirred with new toner particles, and are repeatedly used for a certain period.

Unlike the one-component developer, in the two-component developer, the carrier particles have a function in which the carrier particles are mixed and stirred with the toner particles to triboelectrically charge and convey the toner particles. Thus, the two-component developer has good controllability in designing a developer. Therefore, the two-component developer is suitable for a full color development apparatus requiring high image quality, an apparatus performing high-speed printing requiring reliability and durability of image maintenance, and the like.

In the two-component developer used in this way, it is required that image performance such as image density, fogging, white spots, tone reproduction, and resolution show a specific value from the initial stage, and this performance does not fluctuate during endurance printing and is stably maintained. In order to stably maintain this performance, it is necessary that the performance of carrier particles contained in the two-component developer be stable.

Various kinds of carriers such as an iron powder carrier, a ferrite carrier, a resin-coated ferrite carrier, and a magnetic powder-dispersed resin carrier have conventionally been used as the carrier particles forming the two-component developer.

Recently, an office network has advanced; a copying machine has evolved from a single function copying machine to the age of a composite machine; and a service system has also shifted from a system in which contracted service technicians periodically perform maintenance to replace a developer and the like to the age of a maintenance free system. Thus, a request from the market for further extension of life of a developer has been increasing.

Under such circumstances, attempts have been made to achieve extension of life of a carrier, eventually, a developer by achieving decrease in specific gravity of a carrier to reduce the stress by stirring to prevent shaving and peeling of a layer.

In Japanese Patent Laid-Open No. 2007-034249, a core material having low specific gravity is produced by forming a hollow during sintering by adding a foaming agent in combination with a magnetic component during granulation. However, since a large void is present in particles, strength is low, and when the core material is used as a developer, a crack and a chip occur to cause reduction in charging ability and carrier scattering. Further, a core material having low specific gravity is produced by forming a composite by adding silica during granulation. However, since Si reacts with a magnetic component during sintering, magnetization required for a core material cannot be satisfied, and there is apprehension that charge performance is rendered unsatisfactory by the presence of silica in the core material, and that the strength is reduced.

Further, in Japanese Patent Laid-Open No. 2009-244572, a granulated material having low specific gravity is used as a raw material, which is thermally sprayed to thereby produce a hollow core material to decrease specific gravity. However, since all particles do not have a hollow structure, these particles are apparently light but heavy particles are mixed therewith, and when these particles are mixed and stirred with toner particles, toner fuses with a carrier to produce toner spent.

In Japanese Patent Laid-Open No. 2012-215858, decrease in specific gravity has been achieved by coating porous ferrite particles with resin. However, since this is a production method in which a part of the resin can penetrate the voids of ferrite particles, coat thickness easily varies according to the state of penetration, and it is difficult to control charge performance. Further, when compared with a non-porous core material, the coating amount of the resin will be adjusted by considering the amount of penetration of the resin into a porous core material, and an economic disadvantage will occur.

In Japanese Patent Laid-Open No. 2013-250455, a resin precursor solution in which magnetic particles are dispersed is used to form resin particles in which magnetic particles are dispersed in the process of polymerization, thereby producing a so-called resin carrier having low specific gravity. However, such problems occur that image density is not obtained since carrier resistivity is high; magnetic particulates are eliminated and damage a photo conductor; charge rising performance is poor since residual magnetization and coercive force are high; and the like.

Japanese Patent Laid-Open No. 2014-197040 describes a ferrite carrier core material including porous ferrite particles and a resin-filled ferrite carrier in which voids of the core material are filled with resin. These techniques have allowed production of a carrier that satisfies all the problems accompanying decrease in specific gravity, such as strength, magnetic force, charge, resistivity and the like.

As described in these Patent Literatures, many attempts to decrease specific gravity of a carrier have been performed, and a part of the attempts has been achieved.

On the other hand, reduction of the environmental load is required also for a carrier, and therefore, it is preferred that heavy metals such as Cu, Zn, and Ni be not contained at a higher level than the range of unavoidable impurities (associated impurities) in the carrier composition.

Further, from the point of view of reduction of the environmental load, it is similarly requested that volatile organic compounds (VOC), particularly highly toxic aldehydes, in a carrier be reduced.

However, the cited Japanese Patent Laid-Open No. 2013-250455 has a problem that since an aldehyde is used in the production process, the aldehyde remains in a carrier as a volatile organic compound. The cited Japanese Patent Laid-Open No. 2014-197040 has a problem that since an organic solvent such as toluene is used in the production step, a volatile organic compound such as toluene remains in a carrier.

Therefore, an object of the present invention is to provide a carrier in which decrease in specific gravity is achieved and a volatile organic compound (VOC) is reduced and to provide an electrophotographic developer using the carrier.

SUMMARY OF THE INVENTION

As a result of intensive investigations to solve the problems as described above, the present inventors have found that the above problems can be solved by using a composite of a nonmagnetic material and a magnetic material as a core material and preparing the composite without positively using a potential source of a volatile organic compound (VOC), and have completed the present invention. The present invention has been made based on these findings.

Specifically, the present invention provides a carrier including a core material coated with a resin, the core material including a magnetic component and a nonmagnetic component, wherein the sum total of volatile organic compounds in the carrier is 1 ppb or more and 1.5 ppm or less.

In the carrier according to the present invention, the sum total of aldehydes in the sum total of the volatile organic compounds in the carrier is desirably 1 ppb or more and 0.1 ppm or less.

The carrier according to the present invention desirably has a true specific gravity of 3.0 to 4.5 g/cm$^3$.

In the carrier according to the present invention, the sum total of the volatile organic compounds in the core material is desirably 1 ppb or more and 0.5 ppm or less.

In the carrier according to the present invention, the sum total of aldehydes in the sum total of the volatile organic compounds in the core material is desirably 1 ppb or more and 0.05 ppm or less.

In the carrier according to the present invention, the magnetic component is desirably ferrite particles, and the nonmagnetic component is desirably a cured product of a silane coupling agent or a silicone oligomer.

In the carrier according to the present invention, the ferrite particles are desirably porous ferrite particles, and the voids of the porous ferrite particles are desirably filled with the cured product of the silane coupling agent or the silicone oligomer.

The present invention provides an electrophotographic developer including the carrier and toner.

Effect of the Invention

The carrier according to the present invention is a carrier including a core material coated with a resin, the core material including a magnetic component and a nonmagnetic component, in which decrease in specific gravity is achieved, and since VOCs, particularly aldehydes, are reduced, the requirement of the reduction of the environmental load is met. Thus, the electrophotographic developer using the carrier has improved durability since decrease in specific gravity of the carrier has been achieved.

DETAILED DESCRIPTION OF THE PREFERRED EMBODIMENTS

Embodiments of the present invention will be described below.

<Carrier According to the Present Invention>

The carrier according to the present invention includes a core material coated with a resin, the core material including a magnetic component and a nonmagnetic component.

The magnetic component is preferably ferrite particles, and the composition thereof desirably contains, but is not particularly limited to, at least one selected from the group consisting of Mn, Mg, Li, Ca, Sr, Cu, Zn, and Ni. When the latest flow of the reduction of the environmental load including waste regulation is taken into consideration, it is preferred that heavy metals such as Cu, Zn, and Ni be not contained at a higher level than the range of unavoidable impurities (associated impurities). Here, unless otherwise stated, ferrite particles refer to the aggregate of each ferrite particle, and simply particle refers to each ferrite particle.

The ferrite particles are preferably porous ferrite particles, which desirably have a pore volume of 40 to 100 mm$^3$/g and a peak pore size of 0.3 to 1.5 μm.

When the pore volume and the peak pore size of the porous ferrite particles are in the above range, a nonmagnetic component-filled carrier in which the weight is suitably reduced can be obtained. If the pore volume is less than 40 mm$^3$/g, a sufficient amount of a nonmagnetic component might not be filled and thereby weight saving might not be achieved, and when the volume is more than 100 mm$^3$/g, strength of the carrier might not be maintained even if the nonmagnetic component is filled. Further, when the peak pore size is 0.3 μm or more, the contact area with toner will increase since the size of the unevenness on the surface of the core material will be suitable, and since the triboelectric charging with toner is efficiently performed, the charge rising performance will be improved irrespective of low specific gravity. If the peak pore size is less than 0.3 μm, such an effect might not be obtained, and since the surface of a carrier after the carrier is filled with a nonmagnetic component is smooth, the carrier having low specific gravity might not be given sufficient stress with toner, and the charge rising performance might be deteriorated. Further, if the peak pore size is more than 1.5 μm, the area in which a nonmagnetic component is present will be large relative to the surface area of the particles. Therefore, when the pores are filled with the nonmagnetic component, the aggregation between particles might easily occur, and many aggregated particles and irregular-shaped particles might be present in the carrier particles after being filled with the nonmagnetic component. Therefore, aggregated particles tend to be deagglomerated by the stress in endurance printing, causing charge fluctuation. Further, porous ferrite particles having a peak pore size of more than 1.5 μm tends to show that the surface of the particles has large unevenness. This means that the shape of the particle itself might be poor and the particle might also be poor in strength. Therefore, the carrier particles themselves might be cracked by the stress in endurance printing, causing charge fluctuation.

(Pore Volume and Peak Pore Size)

The pore volume and the peak pore size are examined as follows. Specifically, the examination was performed using mercury porosimeters Pascal140 and Pascal240 (manufactured by Thermo Fisher Scientific Inc.). CD3P (for powder)

was used as a dilatometer; a sample was put in a commercially available gelatin capsule having a plurality of holes; and the capsule was put in the dilatometer. In Pascal140, the dilatometer was deaerated and then filled with mercury, and a low pressure region (0 to 400 kPa) was examined as a 1st Run. Next, deaeration and examination of a low pressure region (0 to 400 kPa) were performed again as a 2nd Run. After the 2nd Run, the total weight of the dilatometer, the mercury, the capsule, and the sample was examined. Next, a high pressure region (0.1 MPa to 200 MPa) was examined in Pascal240. The pore volume, the pore size distribution, and the peak pore size of ferrite particles were determined by the mercury intrusion volume obtained by examining the high pressure part. Further, for determining the pore size, the calculation was performed by defining that mercury has a surface tension of 480 dyn/cm and a contact angle of 141.3°.

As a nonmagnetic component, a coupling agent, a resin, an oligomer, and the like can be used, and particularly, a silane coupling agent and a silicone oligomer are preferably used. Examples of the silane coupling agent include 3-glycidoxypropyltrimethoxysilane, 3-glycidoxypropylmethyldiethoxysilane, vinyltri-methoxysilane, 3-methacryloxypropylmethyldimethoxysilane, 3-methacryloxypropyltriethoxysilane, 3-aminopropyltrimethoxysilane, and N-phenyl-3-aminopropyltrimethoxysilane. Preferred are 3-glycidoxypropyltrimethoxysilane and 3-glycidoxypropylmethyldiethoxy-silane. Examples of the resin include a silicone resin and an acrylic resin. Examples of the silicone oligomer include a methyl silicone oligomer and a methylphenyl silicone oligomer. Here, the silicone oligomer is a generic name for a low-molecular silicone resin, from a dimer to a resin having a weight average molecular weight as determined by gel permeation chromatography of about 1000.

The most preferred embodiment of a core material including a magnetic component and a nonmagnetic component is nonmagnetic component-filled ferrite particles in which the voids of porous ferrite particles are filled with a nonmagnetic component.

The filling amount of the nonmagnetic component relative to the porous ferrite particles is desirably 2 to 20% by weight. If the filling amount of the nonmagnetic component is less than 2% by weight, the inner part of the particles might not be sufficiently filled with the nonmagnetic component. Therefore, when a developer is prepared from these particles and a high electric field is applied to the developer, dielectric breakdown may occur, which may cause image defects such as a white spot. Further, if the filling amount of the nonmagnetic component is more than 20% by weight, the surface might be saturated with excessive resin. Therefore, the resistivity might be excessively high, which may reduce image density when a developer is prepared from these particles. Note that the filling amount of the nonmagnetic component is preferably suitably adjusted depending on the pore volume of the porous ferrite particles.

The nonmagnetic component for filling needs to be such a component that the voids of the porous ferrite particles can be filled with the component without using a volatile organic compound such as toluene. From such a point of view, a silane coupling agent such as 3-glycidoxypropyltrimethoxysilane and a silicone oligomer such a methyl silicone oligomer are preferably used. The nonmagnetic component for filling can be suitably blended with a suitable amount of a metal organic compound such as an alkoxide and a chelate of titanium, zirconium, aluminum, silicon, and tin as a curing catalyst or the like.

The carrier according to the present invention includes a core material coated with a resin, the core material including of a magnetic component and a nonmagnetic component.

Examples of the resin used here include, but are not particularly limited to, a fluororesin, an acrylic resin, an epoxy resin, a polyamide resin, a polyamide-imide resin, a polyester resin, an unsaturated polyester resin, a urea resin, a melamine resin, an alkyd resin, a phenolic resin, a fluorine acrylic resin, an acrylic-styrene resin, a silicone resin, and a modified silicone resin modified with each resin such as an acrylic resin, a polyester resin, an epoxy resin, a polyamide resin, a polyamide-imide resin, an alkyd resin, a urethane resin, and a fluororesin. In the present invention, an acrylic resin, a silicone resin, or a modified silicone resin is preferably used.

The resin may be suitably blended, for example, with a suitable amount of conductive carbon, an oxide such as titanium oxide and tin oxide, various organic conducting agents, or the like as a conducting agent. Further, the resin can be suitably blended, for example, with a suitable amount of nigrosine dye, a quaternary ammonium salt, an organometallic complex, a metal-containing monoazo dye, and a coupling agent such as an aminosilane coupling agent and a fluorine-based silane coupling agent as a charge control agent.

The coating amount of the resin is desirably 0.5 to 4% by weight relative to a core material. If the coating amount of the resin is less than 0.5% by weight, it will be difficult to form a uniform coating layer on the surface of a carrier, and if the coating amount of the resin is more than 4% by weight, the aggregation of carriers might occur, causing reduction in productivity such as reduction in yield and also causing fluctuation in developer performance such as the fluidity and the charge amount in actual equipment when a developer is prepared from the carrier.

Examples of the method of filling with a nonmagnetic component or coating with a resin include a known method, such as a brush painting method, a spray dry method with a fluidized bed, a rotary dry method, and a dip-and-dry method with a universal stirrer. Further, when a core material is baked after it is filled with a nonmagnetic component or coated with a resin, any of an external heating system or an internal heating system, such as a fixed-type or a fluid-type electric furnace, a rotary electric furnace, and a burner furnace, may be employed, or baking with a microwave may be employed. When a UV-cured resin is used as a coating resin, a UV heater can be used. Although the baking temperature is different according to a resin to be used, a temperature equal to or higher than a melting point or a glass transition point is expedient, and in the case of a thermosetting resin, a condensation-crosslinking resin, or the like, it is preferred to increase the temperature to a temperature where the curing sufficiently proceeds.

The sum total of the volatile organic compounds in the carrier according to the present invention is 1 ppb or more and 1.5 ppm or less. A sum total of the volatile organic compounds in the carrier of less than 1 ppb is equal to or less than the measurement limit of an analyzer. Further, if the sum total of the volatile organic compounds in the carrier is more than 1.5 ppm, the amount of VOCs discharged out of a developing machine might be remarkable.

The sum total of the aldehydes in the sum total of the volatile organic compounds in the carrier is desirably 1 ppb or more and 0.1 ppm or less. A sum total of the aldehydes of less than 1 ppb is equal to or less than the measurement limit of an analyzer. Further, if the sum total of the aldehydes is more than 0.1 ppm, the amount of VOCs discharged out of a developing machine might be remarkable.

The sum total of the volatile organic compounds in the core material used for the carrier according to the present invention is desirably 1 ppb or more and 0.5 ppm or less. A sum total of the volatile organic compounds in the core material of less than 1 ppb is equal to or less than the measurement limit of an analyzer. Further, if the sum total of the volatile organic compounds in the core material is more than 0.5 ppm, the sum total as the carrier will be affected, and the amount of VOCs discharged out of a developing machine might be remarkable.

The sum total of the aldehydes in the sum total of the volatile organic compounds in the core material is desirably 1 ppb or more and 0.05 ppm or less. A sum total of the aldehydes of less than 1 ppb is equal to or less than the measurement limit of an analyzer. Further, if the sum total of the aldehydes is more than 0.05 ppm, the sum total as the carrier will be affected, and the amount of VOCs discharged out of a developing machine might be remarkable.

(Volatile Organic Compound)

The volatile organic compound can be examined by referring to JIS A 1901:2003 according to the following procedure.

A sample in an amount of 100 g was put in a stainless steel petri dish having a base area of 80 $cm^2$ to obtain a test piece. A 10-L Tedlar bag (manufactured by GL Science Inc.) was filled with nitrogen and subjected to heat treatment at 80° C.×30 minutes three times repeatedly to rinse the bag. The test piece was put in the heat-treated Tedlar bag, which was sealed and thereto was added 5 L of high purity nitrogen which was passed through activated carbon. The test piece was heated in an oven at 60° C.×2 hours to evaporate VOC components.

A gas containing volatile components in an amount of 1 L was adsorbed on a TENAX-TA collecting tube manufactured by Supelco Inc. which is a solid collecting agent, and non-aldehyde components were subjected to quantitative analysis with a gas chromatograph-mass spectrometer.

Heating introducing device: PerkinElmer TurboMatrix ATD

Gas chromatograph: Agilent Technologies 7890A

Column: Agilent Technologies DB-5MS

Mass spectrometer: Agilent Technologies 5975C

Split ratio: 30:1

In analysis, the time when a peak of hexane was detected on a TIC chromatogram was defined as T1; the time when hexadecane was detected was defined as T2; and all the peaks detected between T1 and T2 were summed up and converted to the concentration of toluene, which was defined as the total evaporation amount of non-aldehyde components.

A gas containing volatile components in an amount of 3 L was adsorbed on an InertSepmini AERO DNPH collecting tube manufactured by GL Sciences Inc. which is a collecting agent for derivatization, and aldehyde components were extracted with a solvent and subjected to quantitative analysis by high performance liquid chromatography.

High performance liquid chromatography: Waters ACQUITY UPLC H-Class system

Detector: Waters ACQUITY UPLC PDA eλ Detector (360 nm)

Column: Waters ACQUITY UPLC HSS C18

Mobile phase: water/acetonitrile/THF

Injection amount: 2 μL

In analysis, each detected aldehyde derivative was subjected to quantitative analysis by a calibration curve method, and the sum total thereof was defined as the total evaporation amount of aldehyde components.

The sum of the total volatilization amount of aldehyde components and the total volatilization amount of non-aldehyde components was defined as the total amount of volatile organic compounds (T-VOC).

Various methods can be employed for setting the content of volatile organic compounds in a core material or a carrier and the content of aldehydes in the volatile organic compounds to the above range. Examples of the methods include selection of a nonmagnetic component and not using a volatile organic solvent at the time of filling. Further examples include not using a volatile organic solvent when a carrier is coated with a resin.

The true specific gravity of the carrier according to the present invention is desirably 3.0 to 4.5 g/$cm^3$. If true specific gravity is less than 3.0 g/$cm^3$, sufficient carrier strength might not be secured, and if the true specific gravity is more than 4.5 g/$cm^3$, the weight saving of the carrier might not be achieved. The true specific gravity was measured using a pycnometer according to JIS R9301-2-1. Here, the true specific gravity was examined at a temperature of 25° C. using methanol as a solvent.

The carrier according to the present invention can be used as an electrophotographic developer in combination with toner.

<Electrophotographic Developer According to the Present Invention>

The carrier according to the present invention obtained as described above can be mixed with toner to be used as a two-component electrophotographic developer.

The toner used in the present invention can be produced by a known method such as a suspension polymerization method, an emulsion polymerization method, and a pulverizing method. Examples of the production method include a method including sufficiently mixing a binder resin, a coloring agent, a charge control agent, and the like in a mixer such as a Henschel mixer; then melt-kneading the resulting mixture in a twin screw extruder or the like to uniformly disperse the mixture; cooling the melt mixture; then finely pulverizing the melt mixture with a jet mill or the like; and classifying the pulverized melt with an air classification machine or the like, thus capable of obtaining toner having a desired particle size after classification. Wax, magnetic powder, a viscosity modifier, and other additives may be incorporated if required. Furthermore, an external additive can also be added after classification.

Examples of the binder resin used for the toner include, but are not particularly limited to, resins such as polystyrene, chloro polystyrene, a styrene-chlorostyrene copolymer, a styrene-acrylate copolymer, a styrene-methacrylic acid copolymer, a rosin-modified maleic resin, an epoxy resin, polyester, polyethylene, polypropylene, polyurethane, and a silicone resin. These resins can be used singly or in combination if required.

Examples of the charge control agent which can be used in the toner include a nigrosine dye, a quaternary ammonium salt, an organometallic complex, a chelate complex, and a metal-containing monoazo dye.

A conventionally known dye and/or a pigment can be used as the coloring agent used for the toner. Examples thereof that can be used include carbon black, phthalocyanine blue, Permanent red, chrome yellow, and phthalocyanine green.

In addition, as an external additive, silica, titanium oxide, barium titanate, fluororesin fine particles, acrylic resin fine particles, and the like can be used singly or in combination.

Hereinafter, the present invention will be specifically described based on Examples and the like.

EXAMPLES

Example 1

Raw materials were weighed so that MnO: 38 mol %, MgO: 11 mol %, $Fe_2O_3$: 50.3 mol %, and SrO: 0.7 mol % might be obtained. The raw materials were pulverized with a dry media mill (a vibrating mill, stainless steel beads each having a diameter of ⅛ inch) for 4.5 hours, and the resulting pulverized material was formed into pellets each having a size of about 1 mm square with a roller compactor. Trimanganese tetraoxide was used as a MnO raw material; magnesium hydroxide was used as a MgO raw material; and strontium carbonate was used as a SrO raw material. Coarse powders of the pellets were removed through a vibration screen having an opening of 3 mm; next, fine powders were removed through a vibration screen having an opening of 0.5 mm; and then the resulting pellets were calcined at 1050° C. for 3 hours in a rotary electric furnace.

Next, the resultants were pulverized to an average diameter of 4 μm using a dry media mill (a vibrating mill, stainless steel beads each having a diameter of ⅛ inch), and thereto was added water. The resulting mixture was further pulverized using a wet media mill (a vertical bead mill, stainless steel beads each having a diameter of 1/16 inch) for 10 hours. A suitable amount of a dispersant was added to the resulting slurry, and thereto was added PVA (20% solution) as a binder in an amount of 0.2% by weight relative to the solid content. Next, the slurry was granulated and dried with a spray dryer, and the particle size of the resulting particles (granulated material) was adjusted. Subsequently, the granulated material was heated at 700° C. for 2 hours in a rotary electric furnace to remove organic components such as a dispersant and a binder.

Subsequently, the resulting granulated material was sintered for 5 hours in an atmosphere of a temperature of 1071° C. and an oxygen concentration of 1.1% by volume in a tunnel electric furnace. At this time, the heating rate was set to 150° C./hour, and the cooling rate was set to 110° C./hour. Subsequently, the resultant was deagglomerated, and further classified to adjust particle size, and subjected to magnetic separation to classify a low magnetic force article, thus obtaining a ferrite carrier core material including porous ferrite particles.

Next, 3-glycidoxypropyltrimethoxysilane (component concentration: 100%) which is a silane coupling agent was prepared as a nonmagnetic component.

One hundred parts by weight of the porous ferrite particles and 10 parts by weight of 3-glycidoxypropyltrimethoxysilane were fed to a universal stirrer to fill the particles with the nonmagnetic component (3-glycidoxypropyltrimethoxysilane) by a dip-and-dry method until the ferrite particles filled with the nonmagnetic component were sufficiently dried. Subsequently, the dried particles were removed from the apparatus, put in an oven of a hot air heating type, and subjected to heat treatment at 250° C. for 1.5 hours.

Subsequently, the resulting particles were cooled to room temperature, and ferrite particles in which the nonmagnetic component was cured were removed. The aggregated particles were deagglomerated through a vibration screen having an opening of 200 M, and the nonmagnetic material which was not used for filling was removed using a magnetic separation machine. Subsequently, coarse particles were removed again through a vibration screen to obtain ferrite particles filled with the nonmagnetic component.

Next, a solid acrylic resin (product name: BR-73, manufactured by Mitsubishi Rayon Co., Ltd.) was prepared, and 20 parts by weight of the acrylic resin was mixed with 80 parts by weight of toluene to dissolve the acrylic resin in toluene, thus preparing a resin solution. To the resin solution, was added carbon black (product name: Mogul L, manufactured by Cabot Corporation) in an amount of 3% by weight relative to the acrylic resin as a conductive agent, thus obtaining a coating resin solution.

The resulting ferrite particles filled with the nonmagnetic component were put in a universal stirrer, and thereto was added the acrylic resin solution to perform resin coating by a dip-and-dry method. Here, the amount of the acrylic resin was set to 2 parts by weight relative to 100 parts by weight of the ferrite particles filled with the nonmagnetic component. After the coating, the particles were heated at 145° C. for 2 hours. Then, the aggregated particles were deagglomerated through a vibration screen having an opening of 200 M, and the nonmagnetic material was removed using a magnetic separation machine. Subsequently, coarse particles were removed again through a vibration screen to obtain a nonmagnetic component-filled ferrite carrier, the surface of which has undergone resin coating.

Example 2

Ferrite particles filled with a nonmagnetic component were obtained in the same manner as in Example 1 except that, after the voids of porous ferrite particles (ferrite carrier core material) obtained in the same manner as in Example 1 were filled with a nonmagnetic component (3-glycidoxypropyltrimethoxysilane), the resulting particles were put in an oven of a hot air heating type and subjected to heat treatment at 145° C. for 1.5 hours. Further, a nonmagnetic component-filled ferrite carrier, the surface of which has undergone resin coating, was obtained in the same manner as in Example 1.

Example 3

Ferrite particles filled with a nonmagnetic component were obtained in the same manner as in Example 1 except that, when the voids of porous ferrite particles (ferrite carrier core material) obtained in the same manner as in Example 1 were filled with a nonmagnetic component, 10 parts by weight of the nonmagnetic component (3-glycidoxypropyltrimethoxysilane) was diluted with 30 parts by weight of water before the voids are filled with the nonmagnetic component. Further, a nonmagnetic component-filled ferrite carrier, the surface of which has undergone resin coating, was obtained in the same manner as in Example 1.

Example 4

Ferrite particles filled with a nonmagnetic component were obtained in the same manner as in Example 1 except that, after the voids of porous ferrite particles (ferrite carrier core material) obtained in the same manner as in Example 1 were filled with a nonmagnetic component (3-glycidoxypropyltrimethoxysilane), the resulting particles were not subjected to heat treatment and not de-agglomerated through a vibration screen. Further, a nonmagnetic component-filled ferrite carrier, the surface of which has undergone resin coating, was obtained in the same manner as in Example 1.

Example 5

Ferrite particles filled with a nonmagnetic component were obtained in the same manner as in Example 1 except that, when the voids of porous ferrite particles (ferrite carrier core material) obtained in the same manner as in Example 1 were filled with a nonmagnetic component, a mixture of 3-glycidoxypropylmethyldiethoxysilane (component concentration: 100%) and 3-aminopropyltriethoxysilane (component concentration: 100%) was used as a nonmagnetic component, and the mixing ratio thereof was set to 9 parts by weight of 3-glycidoxypropylmethyldiethoxysilane and 1 part by weight of 3-aminopropyltriethoxysilane relative to 100 parts by weight of porous ferrite particles. Further, a nonmagnetic component-filled ferrite carrier, the surface of which has undergone resin coating, was obtained in the same manner as in Example 1.

Example 6

Ferrite particles filled with a nonmagnetic component were obtained in the same manner as in Example 1 except that, when the voids of porous ferrite particles (ferrite carrier core material) obtained in the same manner as in Example 1 were filled with a nonmagnetic component, 3-methacryloxypropyltriethoxysilane (component concentration: 100%) was used as a nonmagnetic component, and a catalyst (tetra-n-butyl titanate, component concentration: 100%) was used in an amount of 1% by weight relative to the silane coupling agent. Further, a nonmagnetic component-filled ferrite carrier, the surface of which has undergone resin coating, was obtained in the same manner as in Example 1.

Example 7

Ferrite particles filled with a nonmagnetic component were obtained in the same manner as in Example 1 except that, when the voids of porous ferrite particles (ferrite carrier core material) obtained in the same manner as in Example 1 were filled with a nonmagnetic component, 100 parts by weight of porous ferrite particles was filled with 7.5 parts by weight of a methyl silicone oligomer (component concentration: 100%) as a nonmagnetic component. Further, a nonmagnetic component-filled ferrite carrier, the surface of which has undergone resin coating, was obtained in the same manner as in Example 1.

Example 8

Porous ferrite particles (ferrite carrier core material) and ferrite particles filled with a nonmagnetic component (3-glycidoxypropyltrimethoxysilane) which were obtained in the same manner as in Example 1 were used, and 100 parts by weight of ferrite particles filled with a nonmagnetic component was blended with 2 parts by weight of a solid acrylic resin (product name: BR-73, manufactured by Mitsubishi Rayon Co., Ltd.). These components were stirred and mixed for 30 minutes in a universal stirrer. Next, the resulting mixture was put in a heating kneader, heated from ambient temperature to 145° C. at a rate of 5° C./rain, and subjected to stirring and kneading for 2 hours. Then, the heater was turned off, and the kneaded mixture was cooled for 30 minutes with stirring and then discharged from the apparatus.

Subsequently, the aggregated particles were deagglomerated through a vibration screen having an opening of 200 M, and the nonmagnetic material was removed using a magnetic separation machine. Subsequently, coarse particles were removed again through a vibration screen to obtain a nonmagnetic component-filled ferrite carrier which has undergone resin coating.

COMPARATIVE EXAMPLES

Comparative Example 1

To 25 parts by weight of a methyl silicone resin solution (5 parts by weight as the solid content since the solution is a toluene solution having a resin concentration of 20%), was added titanium diisopropoxy bis(ethyl acetoacetate) as a catalyst in an amount of 25% by weight (3% by weight in terms of Ti atoms) relative to the resin solid content. In addition, thereto was added 3-aminopropyltriethoxysilane as an aminosilane coupling agent in an amount of 5% by weight relative to the resin solid content to obtain a nonmagnetic component filling solution.

The filling solution in an amount of 25 parts by weight was mixed and stirred with 100 parts by weight of porous ferrite particles (ferrite carrier core material) obtained in the same manner as in Example 1 under a reduced pressure of 6.7 kPa (about 50 mmHg) at 60° C., and the voids of the porous ferrite particles were permeated and filled with the nonmagnetic component (methyl silicone resin) while evaporating toluene. The pressure in the container was returned to normal pressure, and toluene was removed substantially completely while continuing stirring under normal pressure. Then, the resulting particles were removed from the filling apparatus and put in a container, which was then put in an oven of a hot air heating type and subjected to heat treatment at 220° C. for 1.5 hours. Ferrite particles filled with a nonmagnetic component were obtained in the same manner as in Example 1 except the above. Further, a nonmagnetic component-filled ferrite carrier, the surface of which has undergone resin coating, was obtained in the same manner as in Example 1.

Comparative Example 2

Ferrite particles filled with a nonmagnetic component were obtained in the same manner as in Comparative Example 1 except that, after the voids of porous ferrite particles (ferrite carrier core material) obtained in the same manner as in Example 1 were filled with a nonmagnetic component (methyl silicone resin), the resulting particles were put in an oven of a hot air heating type and subjected to heat treatment at 250° C. for 3 hours. Further, a nonmagnetic component-filled ferrite carrier, the surface of which has undergone resin coating, was obtained in the same manner as in Example 1.

Comparative Example 3

Ferrite particles filled with a nonmagnetic component (methyl silicone resin) were obtained in the same manner as in Comparative Example 1 using porous ferrite particles (ferrite carrier core material) obtained in the same manner as in Example 1.

One hundred parts by weight of the ferrite particles filled with a nonmagnetic component were blended with 2 parts by weight of a solid acrylic resin (product name: BR-73, manufactured by Mitsubishi Rayon Co., Ltd.). These components were stirred and mixed for 30 minutes in a universal stirrer. Next, the resulting mixture was put in a heating kneader, heated from ambient temperature to 145° C. at a rate of 5° C./rain, and subjected to stirring and kneading for 2 hours. Then, the heater was turned off, and the kneaded mixture was cooled for 30 minutes with stirring and then discharged from the apparatus.

Subsequently, the aggregated particles were deagglomerated through a vibration screen having an opening of 200 M, and the nonmagnetic material was removed using a magnetic separation machine. Subsequently, coarse particles were removed again through a vibration screen to obtain a resin-filled ferrite carrier which has undergone resin coating.

Comparative Example 4

Ferrite particles filled with a nonmagnetic component were obtained in the same manner as in Comparative Example 1 except that, after the voids of porous ferrite particles (ferrite carrier core material) obtained in the same manner as in Example 1 were filled with a nonmagnetic component (methyl silicone resin), the resulting particles were put in an oven of a hot air heating type and subjected to heat treatment at 250° C. for 3 hours. Further, a nonmagnetic component-filled ferrite carrier, the surface of which has undergone resin coating, was obtained in the same manner as in Comparative Example 3.

Comparative Example 5

When the voids of porous ferrite particles (ferrite carrier core material) obtained in the same manner as in Example 1 were filled with a nonmagnetic component, a solution of 5 parts by weight of an isobutylene-maleic anhydride copolymer powder (product name: #110, manufactured by Kuraray Co., Ltd.) in 30 parts by weight of water was used as a nonmagnetic component. However, the voids of the porous ferrite particles were not able to be filled with the nonmagnetic component (isobutylene-maleic anhydride copolymer powder).

Comparative Example 6

A ferrite carrier core material was obtained in the same manner as in Example 1 except that the resulting granulated material was sintered for 5 hours in an atmosphere of a temperature of 1160° C. and an oxygen concentration of 0.7% by volume in a tunnel electric furnace.

One hundred parts by weight of the ferrite particles not filled with a nonmagnetic component were blended with 2 parts by weight of a solid acrylic resin (product name: BR-73, manufactured by Mitsubishi Rayon Co., Ltd.). These components were stirred and mixed for 30 minutes in a universal stirrer. Next, the resulting mixture was put in a heating kneader, heated from ambient temperature to 145° C. at a rate of 5° C./min, and subjected to stirring and kneading for 2 hours. Then, the heater was turned off, and the kneaded mixture was cooled for 30 minutes with stirring and then discharged from the apparatus.

Subsequently, the aggregated particles were deagglomerated through a vibration screen having an opening of 200 M, and the nonmagnetic material was removed using a magnetic separation machine. Subsequently, coarse particles were removed again through a vibration screen to obtain a resin-filled ferrite carrier which has undergone resin coating.

Table 1 shows the regular sintering conditions (regular sintering temperature, oxygen concentration) of the core materials (ferrite particles), the core material performance (pore volume, peak pore size, true specific gravity), and nonmagnetic component filling specification (type and amount added of filler, curing temperature) in Examples 1 to 8 and Comparative Examples 1 to 6. Further, Table 2 shows the nonmagnetic component-filled core material performance (T-VOC content, aldehydes content, non-aldehydes content, true specific gravity), carrier specification (coating resin, coating amount), and carrier performance (T-VOC content, aldehydes content, non-aldehydes content, true specific gravity, charge amount variation rate) in Examples 1 to 8 and Comparative Examples 1 to 6. Here, the method of examining the charge amount variation rate shown in Table 2 is to be described below. Further, other examining methods are as described above.

(Charge Amount Variation Rate)

The charge amount was determined by examining a mixture of a carrier and toner using a suction-type charge measurement apparatus (Epping q/m-meter, manufactured by PES-Laboratorium). A developer was prepared using a commercially available negative polarity toner (cyan toner, manufactured by Fuji Xerox Co., Ltd. for DocuPrint C3530; average particle size: about 5.8 μm) used for a full color printer, in which the amount of the developer was set to 10 g, and the toner density was set to 10% by weight. The prepared developer was put in a 50-cc glass bottle, and the glass bottle was received and fixed in a cylindrical holder having a diameter of 130 mm and a height of 200 mm and stirred for 30 minutes by means of Turbula Mixer manufactured by Shinmaru Enterprise Co., Ltd., and the resulting developer was examined for the charge amount using a net of 635 M.

A developer was prepared using a commercially available negative polarity toner (cyan toner, manufactured by Fuji Xerox Co., Ltd. for DocuPrint C3530; average particle size: about 5.8 μm) which is the same toner as that described above, in which the amount of the developer was set to 20 g, and the toner density was set to 10% by weight. The prepared developer was put in a 50-cc glass bottle, and the glass bottle was stirred for 30 hours by means of a paint shaker manufactured by ASADA IRON WORKS CO., LTD. The developer was removed after completion of stirring, and the toner was sucked using a net of 635 M to remove only the carrier. The resulting carrier was examined for the charge amount by the method for examining the charge amount described above, and the resulting charge amount was defined as a charge amount after forced stirring.

Then, the charge amount variation rate was calculated by the following formula.

$$\text{Charge amount variation rate (\%)} = \frac{\text{(Charge amount value of carrier subjected to forced stirring)}}{\text{(Charge amount value of carrier not subjected to forced stirring)}} \times 100$$

TABLE 1

| | Regular sintering conditions of core material | | Core material performance | | | Filler specification | | |
|---|---|---|---|---|---|---|---|---|
| | Regular sintering temperature (° C.) | Oxygen concentration (vol %) | Pore volume ($mm^3/g$) | Peak pore size (μm) | True specific gravity | Type | Additive (parts by weight) *1 | Curing temperature (° C.) |
| Example 1 | 1071 | 1.1 | 67 | 0.55 | 4.83 | 3-glycidoxypropyltrimethoxysilane | 10 | 250 |
| Example 2 | 1071 | 1.1 | 67 | 0.55 | 4.83 | 3-glycidoxypropyltrimethoxysilane | 10 | 145 |
| Example 3 | 1071 | 1.1 | 67 | 0.55 | 4.83 | 3-glycidoxypropyltrimethoxysilane | 10 | 250 |
| Example 4 | 1071 | 1.1 | 67 | 0.55 | 4.83 | 3-glycidoxypropyltrimethoxysilane | 10 | — |
| Example 5 | 1071 | 1.1 | 67 | 0.55 | 4.83 | 3-glycidoxypropylmethyldiethoxysilane<br>3-aminopropyltriethoxysilane | 9<br>1 | 250 |
| Example 6 | 1071 | 1.1 | 67 | 0.55 | 4.83 | 3-methacryloxypropyltriethoxysilane | 10 | 250 |
| Example 7 | 1071 | 1.1 | 67 | 0.55 | 4.83 | methyl silicone oligomer | 7.5 | 250 |
| Example 8 | 1071 | 1.1 | 67 | 0.55 | 4.83 | 3-glycidoxypropyltrimethoxysilane | 10 | 250 |
| Comparative Example 1 | 1071 | 1.1 | 67 | 0.55 | 4.83 | methyl silicone resin | 5 | 220 |
| Comparative Example 2 | 1071 | 1.1 | 67 | 0.55 | 4.83 | methyl silicone resin | 5 | 250 |
| Comparative Example 3 | 1071 | 1.1 | 67 | 0.55 | 4.83 | methyl silicone resin | 5 | 220 |
| Comparative Example 4 | 1071 | 1.1 | 67 | 0.55 | 4.83 | methyl silicone resin | 5 | 250 |
| Comparative Example 5 | 1071 | 1.1 | 67 | 0.55 | 4.83 | isobutylene-maleic anhydride copolymer | 5 | — |
| Comparative Example 6 | 1160 | 0.7 | 4 | 0.17 | 4.83 | — | — | — |

*1: Amount relative to 100 parts by weight of core material

TABLE 2

| | Nonmagnetic component-filled core material performance | | | | Carrier specification | | Carrier performance | | | | |
|---|---|---|---|---|---|---|---|---|---|---|---|
| | T-VOC content (ppm) | Aldehydes content (ppm) | Non-aldehydes content (ppm) | True specific gravity | Coating resin | Coating amount (parts by weight) *2 | T-VOC content (ppm) | Aldehydes content (ppm) | Non-aldehydes content (ppm) | True specific gravity | Charge amount variation rate (%) |
| Example 1 | 0.086 | 0.0094 | 0.077 | 4.28 | Acrylic resin | 2 | 1.0 | 0.042 | 0.99 | 4.04 | 96 |
| Example 2 | 0.12 | 0.021 | 0.10 | 4.07 | Acrylic resin | 2 | 1.2 | 0.058 | 1.1 | 3.87 | 94 |
| Example 3 | 0.10 | 0.014 | 0.088 | 4.27 | Acrylic resin | 2 | 1.0 | 0.045 | 1.0 | 4.02 | 96 |
| Example 4 | — | — | — | — | Acrylic resin | 2 | 1.3 | 0.078 | 1.2 | 4.03 | 95 |
| Example 5 | 0.098 | 0.015 | 0.083 | 4.23 | Acrylic resin | 2 | 1.1 | 0.061 | 1.0 | 4.05 | 95 |
| Example 6 | 0.11 | 0.017 | 0.091 | 4.27 | Acrylic resin | 2 | 1.2 | 0.057 | 1.1 | 4.04 | 97 |
| Example 7 | 0.077 | 0.0083 | 0.069 | 4.27 | Acrylic resin | 2 | 1.0 | 0.038 | 0.98 | 4.02 | 96 |
| Example 8 | 0.086 | 0.0094 | 0.077 | 4.28 | Acrylic resin | 2 | 0.10 | 0.011 | 0.086 | 4.03 | 91 |
| Comparative Example 1 | 1.8 | 0.072 | 1.7 | 4.27 | Acrylic resin | 2 | 2.7 | 0.12 | 2.6 | 4.02 | 96 |
| Comparative Example 2 | 1.7 | 0.069 | 1.6 | 4.29 | Acrylic resin | 2 | 2.6 | 0.11 | 2.5 | 4.00 | 97 |
| Comparative Example 3 | 1.8 | 0.072 | 1.7 | 4.27 | Acrylic resin | 2 | 1.8 | 0.073 | 1.7 | 4.03 | 90 |
| Comparative Example 4 | 1.7 | 0.069 | 1.6 | 4.29 | Acrylic resin | 2 | 1.7 | 0.070 | 1.6 | 3.99 | 90 |
| Comparative Example 5 | — | — | — | — | — | — | — | — | — | — | — |
| Comparative Example 6 | — | — | — | — | Acrylic resin | 2 | 0.0081 | 0.0014 | 0.0067 | 4.69 | 65 |

*2: Amount relative to 100 parts by weight of nonmagnetic component-filled core material As shown in Table 2, in Examples 1 to 8, the content of the volatile organic compounds in a carrier is in the allowable range, and decrease in specific gravity is achieved, while in Comparative Examples 1 to 4, the content of the volatile organic compounds in a carrier was higher than the allowable range. Further, in Comparative Example 5, the voids of porous ferrite particles were not able to be filled with a nonmagnetic component, as described above. In Comparative Example 6, although the content of the volatile organic compounds in a carrier was in the allowable range, decrease in specific gravity was not able to be achieved as apparent from the results of the true specific gravity and the charge amount variation rate.

INDUSTRIAL APPLICABILITY

In the carrier according to the present invention, decrease in specific gravity is achieved, and volatile organic compounds (VOC), particularly aldehydes, are reduced.

Therefore, when an electrophotographic developer is prepared from the carrier and toner, the developer is excellent in durability, and the requirement of the reduction of the environmental load is met.

What is claimed is:

1. A carrier comprising a core material coated with a resin, the core material comprising a magnetic component, the magnetic component being porous ferrite particles having voids, and wherein the voids are filled with a nonmagnetic component filling the voids of the porous ferrite particles;

being a cured product of a silane coupling agent or a methyl silicone oligomer, and filling the voids of the porous ferrite particles;

wherein the carrier contains volatile organic compounds which evaporate by heating at 60° C. for 2 hours, and the sum total of the volatile organic compounds in the carrier, which is defined as a sum total of the total evaporation amount of non-aldehyde components subjected to quantitative analysis with a gas chromatograph-mass spectrometer and the total evaporation amount of aldehyde components measured by high performance liquid chromatography is 1 ppb or more and 1.5 ppm or less;

the silane coupling agent being any of 3-glycidoxypropyltrimethoxysilane, 3-glycidoxypropylmethyldiethoxysilane, and 3-methacryloxypropyltriethoxysilane.

2. The carrier according to claim 1, wherein a sum total of aldehydes in the sum total of the volatile organic compounds in the carrier is 1 ppb or more and 0.1 ppm or less.

3. The carrier according to claim 1, wherein the carrier has a true specific gravity of 3.0 to 4.5 g/cm$^3$.

4. The carrier according to claim 1, wherein a sum total of the volatile organic compounds in the core material is 1 ppb or more and 0.5 ppm or less.

5. The carrier according to claim 4, wherein a sum total of aldehydes in the sum total of the volatile organic compounds in the core material is 1 ppb or more and 0.05 ppm or less.

6. An electrophotographic developer comprising the carrier according to claim 1.

7. The carrier according to claim 1, wherein the nonmagnetic component has been filled into the voids of the porous ferrite particles by a dip-and-dry method.

* * * * *